US010987546B2

(12) United States Patent
McCord

(10) Patent No.: US 10,987,546 B2
(45) Date of Patent: Apr. 27, 2021

(54) HYDRODYNAMIC HUMAN-POWERED PROPULSION MECHANISM

(71) Applicant: Mark A. McCord, Los Gatos, CA (US)

(72) Inventor: Mark A. McCord, Los Gatos, CA (US)

( * ) Notice: Subject to any disclaimer, the term of this patent is extended or adjusted under 35 U.S.C. 154(b) by 0 days.

(21) Appl. No.: 16/590,188

(22) Filed: Oct. 1, 2019

(65) Prior Publication Data

US 2020/0108295 A1 Apr. 9, 2020

Related U.S. Application Data

(60) Provisional application No. 62/740,935, filed on Oct. 3, 2018.

(51) Int. Cl.
*A63B 31/08* (2006.01)
*A63B 31/11* (2006.01)

(52) U.S. Cl.
CPC ..... *A63B 31/11* (2013.01); *A63B 2031/112* (2013.01)

(58) Field of Classification Search
CPC ... A63B 31/11; A63B 2031/112; A63B 31/08; A63B 31/10; A63B 2031/115; A63B 2031/117; A63B 31/12
USPC ..... 441/61–64
See application file for complete search history.

(56) References Cited

U.S. PATENT DOCUMENTS 3,081,467 A * 3/1963 Ciccotelli ..... A63B 31/14 441/63
3,665,535 A * 5/1972 Picken ..... A63B 31/11 441/64
4,178,128 A 12/1979 Gongwer
4,767,368 A 8/1988 Ciccotelli
4,944,703 A 7/1990 Mosier
5,326,296 A * 7/1994 De Jesus ..... A63B 31/11 441/60
5,417,599 A * 5/1995 Evans ..... A63B 31/11 441/64
5,536,190 A 7/1996 Althen
6,050,868 A * 4/2000 McCarthy ..... A63B 31/11 441/64
6,109,990 A * 8/2000 Lundberg ..... A63B 21/0084 441/64
6,371,821 B1 * 4/2002 McCarthy ..... A63B 31/11 441/64
6,482,059 B2 * 11/2002 McCarthy ..... A63B 31/11 441/64
7,083,485 B2 8/2006 Melius
8,480,446 B2 7/2013 Woods
(Continued)

*Primary Examiner* — Daniel V Venne

(57) ABSTRACT

One embodiment of improved swim fins consists of a right foot attachment (101) with an outer right blade (111) and an inner right blade (112) which is arranged such that it does not mechanically interfere with an inner left blade (113). The blades may include a pivot mechanism (220) that allows the blades to maintain an optimal angle of attack as the swimmer moves their legs up and down. In another embodiment, a right blade (1011) and a left blade (1013) are attached to the feet of a person who is propelled by the blades above the surface of the water as they pump their feet up and down, forming a human-powered hydrofoil. Other embodiments are described and shown.

20 Claims, 14 Drawing Sheets

(56) References Cited

U.S. PATENT DOCUMENTS 8,900,023 B2 * 12/2014 Wallmark ..... A63B 31/11
441/63
8,926,385 B1 1/2015 Woods

* cited by examiner

HYDRODYNAMIC HUMAN-POWERED PROPULSION MECHANISM

CROSS-REFERENCE TO RELATED APPLICATIONS

This application claims priority to the provisional application 62/740,935 filed on Oct. 3, 2018, the entire contents of which are fully incorporated herein by this reference.

TECHNICAL FIELD

This invention relates to swim fins used to efficiently propel a swimmer, snorkeler, or scuba diver through the water. In an alternative embodiment, this invention relates to a human-powered hydrofoil with underwater blades or foils that provide lift to hold a person out of the water while also providing a forward force to propel the person forward above the water surface.

BACKGROUND ART

Background—Prior Art

The following is a tabulation of some prior art that presently appears relevant and is discussed:

| U.S. Pat. No. | Issue Date | Patentee |
|---|---|---|
| 4,178,128 | Dec. 11, 1979 | Gongwer |
| 4,767,368 | Aug. 30, 1988 | Ciccotelli |
| 4,944,703 | Jul. 31, 1990 | Mosier |
| 5,536,190 | Jul. 16, 1996 | Althen |
| 7,083,485 | Aug. 1, 2006 | Melius |
| 8,480,446 | Jul. 9, 2013 | Woods |
| 8,926,385 | Jan. 6, 2015 | Woods, et al. |

Traditional swim fins do not have a shape or profile that is very hydrodynamic. High efficiency is best obtained from blades or foils that have a high aspect ratio; for example, foils that have a width longer than their chord. For best lift to drag ratio, they should also have a hydrodynamic cambered shape with a blunt leading edge and sharper trailing edge. Several inventions have been filed in an attempt to improve the performance of swim fins, but none have been practical to date. U.S. Pat. No. 8,926,385 (and similar U.S. Pat. Nos. 8,480,446, 5,536,190, and 4,944,703) describes a swim fin with multiple articulating blades that each have a hydrodynamic shape. However, this invention has a disadvantage that the width of the blades is limited by potential mechanical interference between the left foot blades and the right foot blades. U.S. Pat. No. 7,083,485 describes a fish-shaped swim fin with blades on the inside and outside edges of the foot attachment. Again, the width of the blades is limited to prevent interference between the left foot blades and the right foot blades. U.S. Pat. No. 4,767,368 (and similarly U.S. Pat. No. 4,178,128) attempts to correct for the limitation on the width of the blades by placing one blade in front of the other. However, in this patent, the center of effort of one blade is placed differently, farther from the body, than the other blade. This asymmetry between the left and right swim fins may cause strain on the feet and legs, or cause the swimmer's body to rotate in the water, or cause the swimmer to tend to swim in circles rather than proceed forward in a straight line.

SUMMARY OF THE EMBODIMENTS

A highly efficient hydrodynamic set of foil blades takes the place of a traditional swim fin, or in another embodiment, acts as a human-powered hydrofoil. In a first embodiment, two blades are attached to each foot by a foot attachment; one on the inside of the foot attachment, and one on the outside of the foot attachment. In a second embodiment, a single blade, wider than the length of its chord, is attached to each foot, but the blades are angled or designed with a non-linear shape. In both embodiments, the blades are arranged such that an inner portion of the blade(s) on the right foot can pass by an inner portion of the blade(s) on the left foot without mechanical interference or contact, thus allowing for high aspect ratio blades without the swimmer having to spread their legs far apart. The blades attach to a foot attachment, foot pocket, or shoe, and may be arranged such that the sole of the foot stays at a more natural angle to the leg while moving up and down in a swimming motion. The blade arrangement on the left foot is substantially identical to the blade arrangement on the right foot, providing each foot with equal resistance and thrust through the water. The blades may be fabricated from a strong, stiff, lightweight material that is shaped in an airfoil cross-section. Typical materials may include fiberglass, carbon fiber, and similar fiber-filled plastic or epoxy materials. A pivot mechanism allows the blades to maintain an optimal angle of attack as the swimmer moves their legs up and down.

In another embodiment, the foil blades are attached to the feet of a person and arranged so that they operate with the person in an upright stance. As the person pumps their legs up and down, the blades propel the person upward and forward so that the resulting action is a human-powered hydrofoil. The blades are angled with respect to the foot attachment, or designed with a non-linear form, such that they do not interfere with each other as the person moves their legs up and down.

DETAILED DESCRIPTION OF THE SPECIFIC EMBODIMENTS

Figure 1:
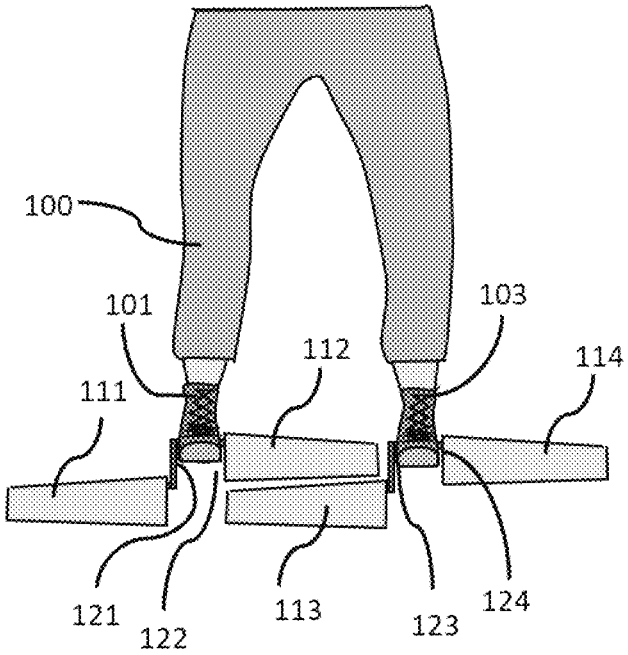
FIG. 1 illustrates schematically one embodiment of the pair of devices for propelling a person through the water, or swim fins, being worn by a swimmer. It also illustrates a mechanical configuration that allows the blades to pass each other without interference as the swimmer moves their legs up and down.

In a first embodiment, a highly efficient hydrodynamic set of foil blades takes the place of a traditional swim fin. A foot attachment, shoe, or foot pocket holds each blade or set of blades firmly to the swimmer's foot. The blades have a relatively high aspect ratio; e.g. they are wider in the direction perpendicular to the swimmer's body than a traditional swim fin, which improves the hydrodynamic efficiency. The left blade is arranged to overlap with the right blade to allow the high aspect ratio without the swimmer having to hold their legs far apart. The blades are further arranged so that even though they overlap left and right, they can pass by each other without mechanical interference as the swimmer moves their legs up and down. Despite this, the overall arrangement of the blades is substantially similar between the left foot and the right foot, such that each leg encounters substantially equal resistance and generates substantially equal thrust. The blades may be arranged so that the sole of the foot stays at a more natural angle to the leg while swimming, when compared to a traditional swim fin where the foot is extended such that the sole is nearly parallel to the leg. In some embodiments, this angle may be between 90 and 120 degrees; in other embodiments this angle may be between 120 and 150 degrees. The blades may be fabricated from a strong, stiff, lightweight material that is easily given an airfoil shape. Typical materials may include fiberglass, carbon fiber, high-strength plastic, and similar fiber-filled plastic or epoxy materials.

The blades may be pivoted or hinged at the point of attachment to the foot using a shaft with a bearing or other similar arrangement. The blades can be joined through a single pivot, or each can pivot separately. The pivot may be arranged to have a limited range of motion to keep the blades near an ideal angle of attack. The center of lift of the blades may be placed somewhat behind the hinge so that the force of water automatically pivots the blades and thus sets the attack angle to an optimal position. A spring mechanism may be added to help control the angle of attack, so that the angle adjusts automatically depending on how much force the swimmer applies to their stroke. The spring mechanism may be either a coil spring or a leaf spring. In some embodiments, the spring mechanism also functions as the pivot mechanism. A screw mechanism or other adjustment mechanism known to those skilled in the art may be used to help set the optimal angle of attack for different conditions or different swimmers.

A dual spring arrangement may be used so that the spring force on the upstroke is different, preferably weaker, than the downstroke; this compensates for the fact that the upstroke muscles in the leg may be weaker. Also, a flexible rubber or polymeric attachment may take the place of the pivot, or the spring mechanism, or both. Finally, a hydraulic cylinder with a controlled leak or similar mechanism may be used to allow a time-dependent angle of attack, so as the leg bends farther into the up- or downstroke, the angle of the blade relative to the foot increases during the time of the stroke to maintain an optimal angle of attack.

The blades may be attached to the shoe or foot attachment with a quick-disconnect mount. This allows the user to walk normally from a beach, off a boat or down a ladder, then quickly attach the blades once in the water. The quick-disconnect mount may be a snap-fit, a twist-lock, a spring-loaded pin or pins, or other quick-disconnect mechanism known to those skilled in the art.

The blades and foot attachment may incorporate several features to improve hydrodynamics, in addition to a hydrodynamic foil shape. The blades may have winglets or endplates to reduce eddies at the tips. The left foot attachment and the right foot attachment may include a left fairing and a right fairing on the top of the foot attachment to reduce water resistance; the blade attachment may have a matching fairing on the underside of the foot attachment. The fairing may also cover the pivot mechanism, and in addition may also serve as an endplate to the inboard end of the blades to minimize turbulence under the foot attachment.

One key advantage of the invention compared to the prior art is that the center of pressure for each blade in the longitudinal direction (parallel to the body) is the same distance from the swimmer's body, while the center of pressure of each blade in the direction perpendicular to the swimmer's body is centered about each corresponding foot attachment. This allows the swimmer to have even strokes with substantially the same force applied to each leg, while eliminating any twisting motion of the swim fin about the leg, or unintentional turning of the swimmer relative to the desired direction of motion.

FIG. 1 illustrates schematically an embodiment of the swim fins attached to a swimmer 100, consisting of the following parts. A right foot attachment 101 attaches the right fin mechanism to the swimmer's right foot, and a left foot attachment 103 attaches the left fin mechanism to the swimmer's left foot; a set of four blades 111, 112, 113, and 114 are attached to the left fin mechanism and the right fin mechanism. The right fin mechanism has a right outer blade 111 attached to an outside 121 of the right foot attachment and a right inner blade 112 attached to an inside 122 of the right foot attachment. Similarly, the left fin mechanism has a left inner blade 113 attached to an inside 123 of the left foot attachment and a left outer blade 114 attached to an outside 124 of the left foot attachment. As shown in FIG. 1 the left inner blade 113 is positioned farther from the swimmer 100 relative to the right inner blade 112 such that the left inner blade 113 can thereby pass the right inner blade 112 without contact as the swimmer 100 strokes their legs up and down. This arrangement allows a relatively wide blade span without the swimmer 100 having to hold their legs too far apart. As is obvious to one skilled in the art, the opposite arrangement with the left inner blade 113 closer to the swimmer 100 than the right inner blade 112 is equally possible. In some embodiments, the set of four blades 111, 112, 113, and 114 have a width between 5 inches and 15 inches, and a chord between 2 inches and 8 inches. A typical dimension of blades 111, 112, 113, and 114 would be 10 inches wide with a chord of 5 inches.

Figure 2:
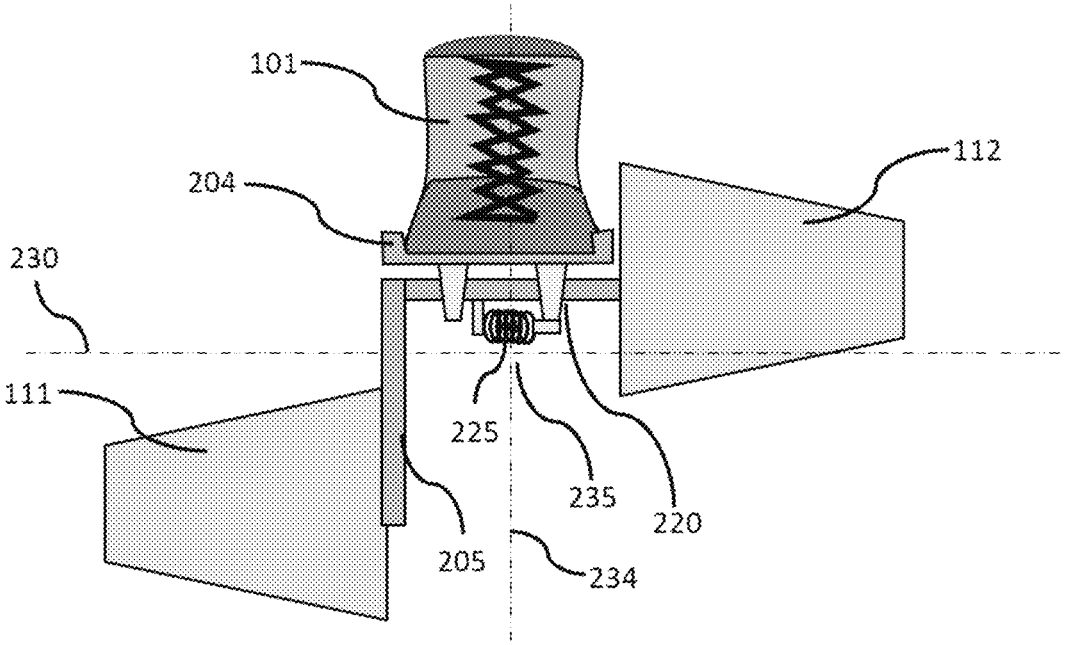
FIG. 2 illustrates schematically one of the foot attachments, or shoe, and the hydrodynamic blades attached to the foot attachment with a pivot and a spring mechanism.

FIG. 2 illustrates schematically a more detailed view of one embodiment of the right swim fin. A right disconnect mechanism 204 allows the swimmer to quickly and easily attach and detach the fin from the foot attachment. The left swim fin similarly has a left disconnect mechanism. This allows the swimmer to walk normally with the fin detached, and then attach the fins once having entered the water. A right pivot mechanism 220 allows the angle of attack of the blades to change between an upstroke and a downstroke of the leg; a left pivot mechanism is similarly disposed on the left swim fin, so that the set of four blades can change an angle with respect to the foot attachment as the person moves the left foot attachment and the right foot attachment either upwards or downwards. The pivot mechanism may be a sleeve bearing as shown, or could also be a ball bearing, roller bearing, spring flexure, or other rotary bearing or pivot mechanism known to those skilled in the art. The right outer blade 111 and the right inner blade 112 are rigidly coupled by connecting element 205 which in turn connects to the pivot mechanism 220. The connecting element 205 is constructed in such a way that a right combined center of pressure 235 of the right inner blade 112 and the right outer blade 111 in the longitudinal direction parallel to the body, as shown by line 230, is located further from the swimmer 100 than the right pivot mechanism 220. This arrangement allows the force of the water on the blades to pivot them automatically to the preferred angle of attack for optimal propulsion through the water. The left swim fin is arranged with a similar left combined center of pressure of the left inner blade and the left outer blade further from the left pivot mechanism in the longitudinal direction. A position of the right combined center of pressure 235 in the lateral direction perpendicular to the body, as shown by line 234, of blades 111 and 112 is substantially centered on the foot attachment 101, to minimize any twisting force on the swimmer's leg. A spring mechanism 225 may be used to help maintain the preferred angle of attack, which can vary with the force of the swimmer's stroke. Alternative arrangements to a conventional spring can include a rubber bumper(s), rubber band, a spring flexure of metal or plastic, or other elastic materials known to those skilled in the art. The left swim fin is geometrically similar to the right swim fin, not a mirror image. A combined longitudinal center of pressure of the left swim fin is a substantially equal distance from the swimmer's body as is a combined longitudinal center of pressure 230 of the right fin. This arrangement helps ensure that the left and right feet generate substantially equal thrust with substantially equal force.

Figure 3:
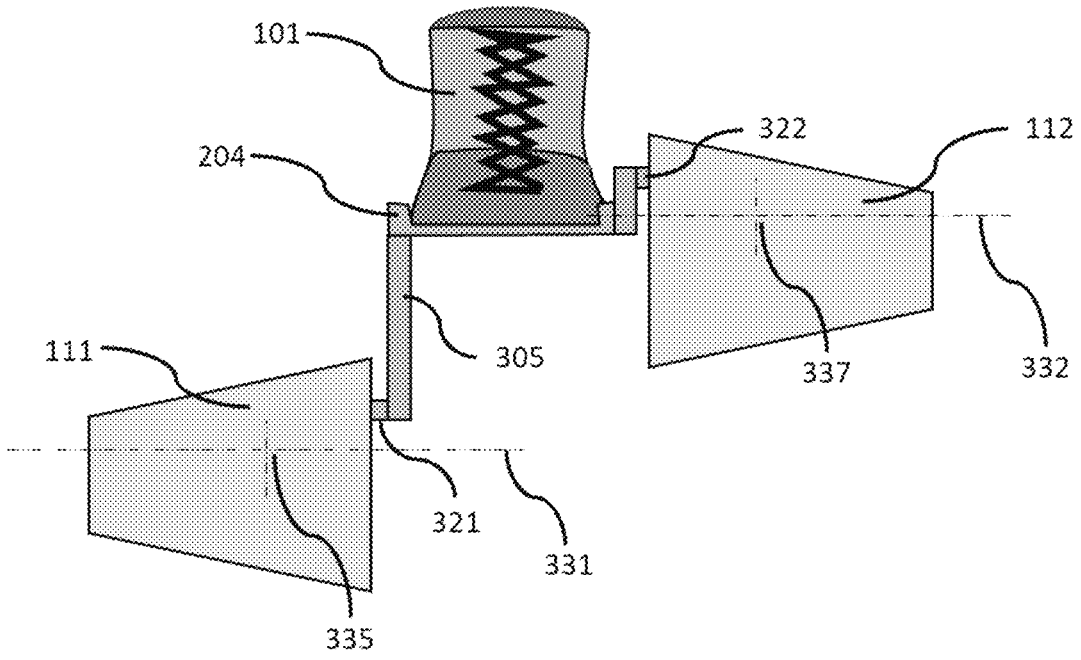
FIG. 3 illustrates schematically an alternative embodiment of the blades and their connection to the foot attachment.

FIG. 3 illustrates an alternative embodiment of a right swim fin. In this embodiment, the blades have independent pivots 321 for the right outer blade 111 and pivot 322 for the right inner blade 112. The pivots 321 and 322 are attached to connecting element 305 which in turn is rigidly attached to the foot attachment 101, through the disconnect mechanism 204. A spring mechanism such as 225 shown in FIG. 2 may be included and attached to pivots 321 and 322 to help maintain the optimal angle of attack. The center of pressure 335 for the right outer blade 111 is positioned further from the swimmer 100 than the pivot 321, as indicated by line 331. This arrangement allows the force of the water on the blade 111 to pivot it automatically to the preferred angle of attack for optimal propulsion through the water. Likewise, the center of pressure 337 for the right inside blade 112 is positioned farther from the swimmer 100 than the pivot 322, as indicated by line 332.

Figure 4:
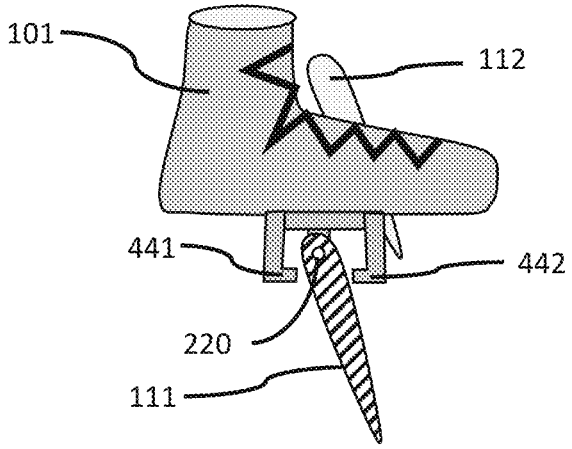
FIG. 4 illustrates schematically a side view of the foot attachment and a cross-section of one of the blades with a hydrodynamic foil shape, as well as a stop mechanism to limit the range of pivoting motion.

FIG. 4 illustrates a side view of the right swim fin. A cross-section of blade 111 shows an aerodynamic profile used in a preferred embodiment. Included in the pivot mechanism 220 are stops 441 and 442 that limit how far the blade can pivot, and thus help maintain the optimal angle of attack. The stops can be arranged to act directly on the blade as shown, or they can instead be arranged to act on the connecting element 205 from FIG. 2, or on an axle used in conjunction with the bearing. Alternative arrangements of the stops, such as a keyed axle, or a protrusion in an axed or connecting element 205 from FIG. 2, or other arrangements to limit motion known to those skilled in the art may be employed. Either stops 441 and 442, or the spring mechanism 225, or both stops 441 and 442 and spring mechanism 225 from FIG. 2 in combination, may be used to control and optimize the angle of attack. Additionally, the stops may be made adjustable to optimize the angle of attack for different swimmers or different conditions.

Figure 5A:
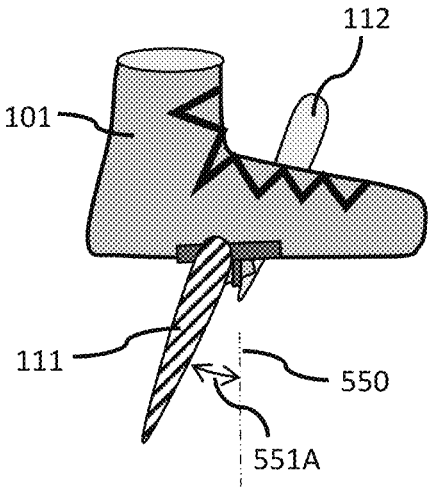
FIG. 5A and FIG. 5B illustrate schematically the blades in different pivot positions for a forward stroke of the foot (FIG. 5A) and a backward stroke of the foot (FIG. 5B).
Figure 5B:
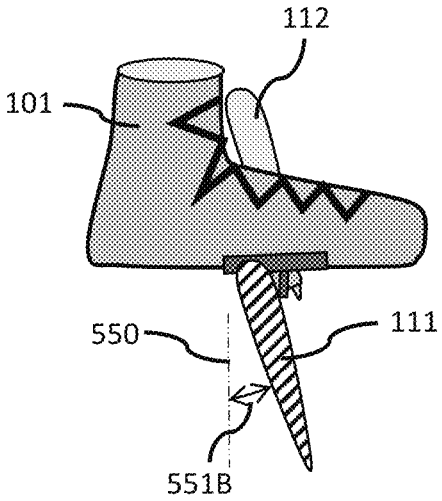

FIG. 5A and FIG. 5B illustrate how the blades 111 and 112 pivot to change the angle with respect to the foot attachment to maintain an optimal angle of attack. FIG. 5A represents a position of the blades 111 and 112 when the foot is moving forward (toward the right in FIG. 5A) with respect to a longitudinal line through the body of the swimmer 100. Water pressure against the trailing edge of the blades 111 and 112 helps position the blades at an angle 551A with respect to a line 550 parallel to the body of the swimmer 100. FIG. 5B illustrates a position of blades 111 and 112 when the foot is moving backwards (toward the left of FIG. 5B), with a different angle 551B with respect to the line 550 parallel to the body of the swimmer 100. Although a sole of the foot attachment 101 is shown perpendicular to the line 550, different orientations of the foot attachment are possible; in one embodiment, the sole of the foot attachment may be positioned at a much smaller angle with respect to 550, which would be a configuration more similar to a traditional swim fin.

Figure 6:
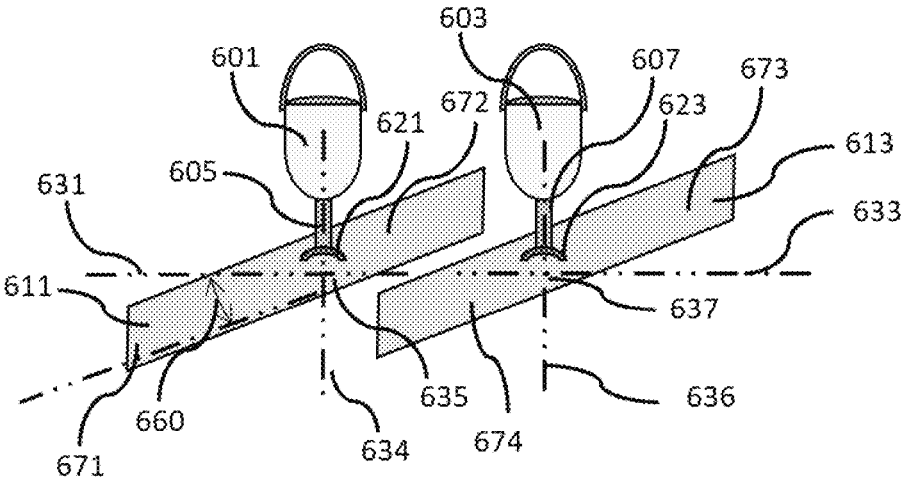
FIG. 6 illustrates schematically an alternative embodiment of the swim fin with a single blade for each foot that is angled with respect to the centerline of the swimmer's body so the blades can pass each other without interference.

FIG. 6 shows an alternative embodiment of the swim fins, where each foot attachment 601 and 603 has only a single blade: a right blade 611 and a left blade 613. The right blade has an outer portion 671 and an inner portion 672. Likewise the left blade has an outer portion 673 and an inner portion 674; the left blade and the right blade are longer in a lateral direction perpendicular to the body than in a longitudinal direction parallel to the body, as shown in FIG. 6. As in previous embodiments, the blades 611 and 613 are connected to the foot attachments 601 and 603 with a pivot mechanism 621 and a pivot mechanism 623. A connecting element 605 and a connecting element 607 may be used to connect the pivot mechanism to the foot attachments 601 and 603. The pivot mechanism 621 and 623 may be comprised of a spring flexure, or include spring mechanism 225 as shown in FIG. 2 or stops 441, 442 as shown in FIG. 4 to control and limit the pivot motion of the blades such that the blades are positioned at a substantially optimal angle of attack with respect to the motion through the water. The blades 611 and 613 are attached at an angle 660 with respect to the perpendicular to the centerline of the swimmer's body such that the inner portion of right blade 611 can pass by the inner portion of the left blade 613 without contact as the swimmer moves their legs up and down. A center of pressure 635 of the right blade 611 is substantially in line with the right foot attachment 601 in the lateral direction as shown by line 634 to prevent any twisting force on the swimmer's foot. Similarly, a center of pressure 637 of the left blade is substantially in line with the left foot attachment 603 in the lateral direction as shown by line 636. In addition, the center of pressure 635 of the right blade 611 in the longitudinal direction indicated by line 631 and the center of pressure 637 of the left blade 613 in the longitudinal direction indicated by line 633 are substantially in line with each other and equally distant from the body of the swimmer 100 so that the swimming forces on the left and right feet of the swimmer 100 are substantially equal.

Figure 7:
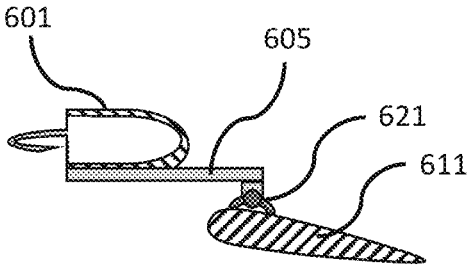
FIG. 7 illustrates schematically a side view of the swim fin with of FIG. 6 showing a pivoting attachment and a hydrodynamic blade profile.

FIG. 7. shows a cross-sectional view of the right swim fin depicted in FIG. 6. The blade 611 preferably has an airfoil shape for improved efficiency. The pivot attachment 621 allows the blade 611 to pivot up and down with respect to the foot attachment 601 to maintain an optimal angle of attack of the blade 611 with respect to the motion of the water as the swimmer 100 moves their leg up and down.

Figure 8:
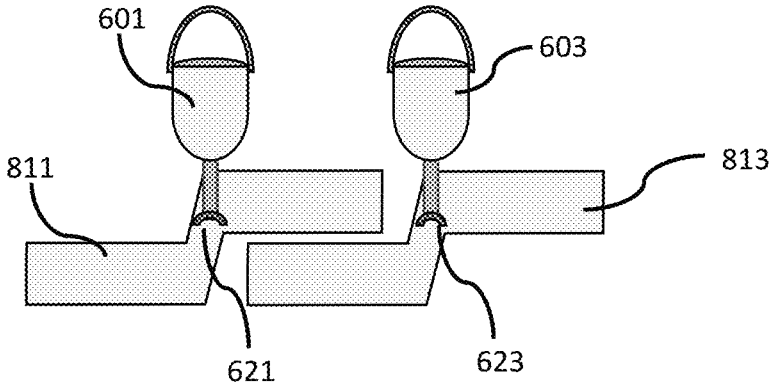
FIG. 8 illustrates schematically an alternative embodiment of the swim fin with a single blade for each foot, where each blade has a jog in its centerline that allows the blades to pass by each other without interference.

FIG. 8. illustrates an alternative embodiment of the swim fins shown in FIG. 6. A right blade 811 has a jog between the inner portion and the outer portion, such that the inner portion is positioned closer to the body of the swimmer 100. A left blade 813 has a similar jog, with the result that the inner portion of the left blade is farther from the body of the swimmer 100. This allows the two blades 811 and 813 to pass by each other without interference as the swimmer 100 moves their legs alternately up and down.

Figure 9:
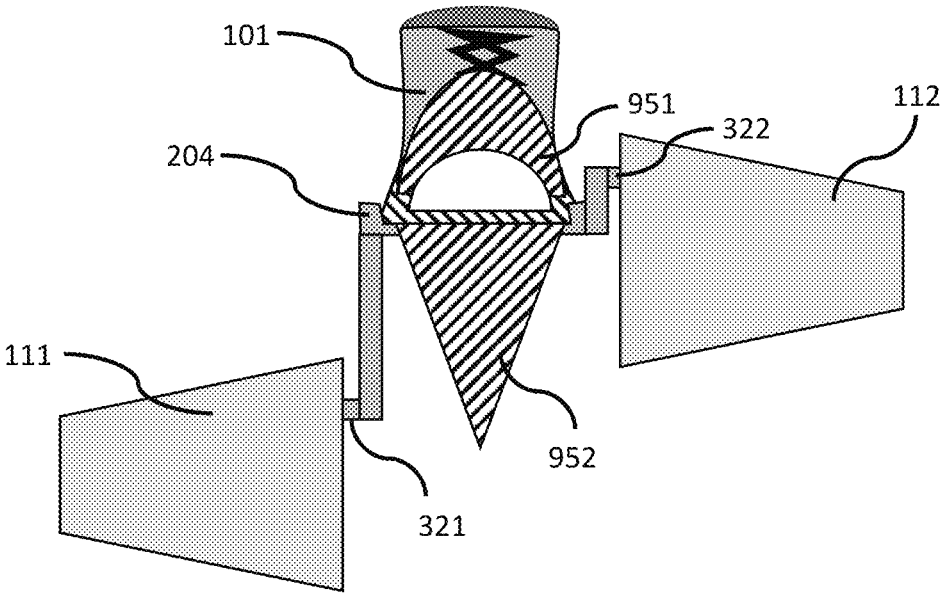
FIG. 9 illustrates schematically an improvement to the foot attachment of the swim fin where hydrodynamic fairings are attached to the upper and under portions of the foot attachment.

FIG. 9 illustrates a modification to the foot attachment 101 to improve hydrodynamic efficiency and reduce drag. An upper fairing 951 is attached to the top of the foot attachment 101 and a lower fairing 952 is attached to the sole of the foot attachment 101. Together the fairings may combine to form an airfoil shape. The lower fairing 952 may also cover some or all of the pivot 220 and the spring mechanism 225 from FIG. 2, and the stops 441 and 442 from FIG. 4 to further streamline the fin and reduce drag.

Figure 10:
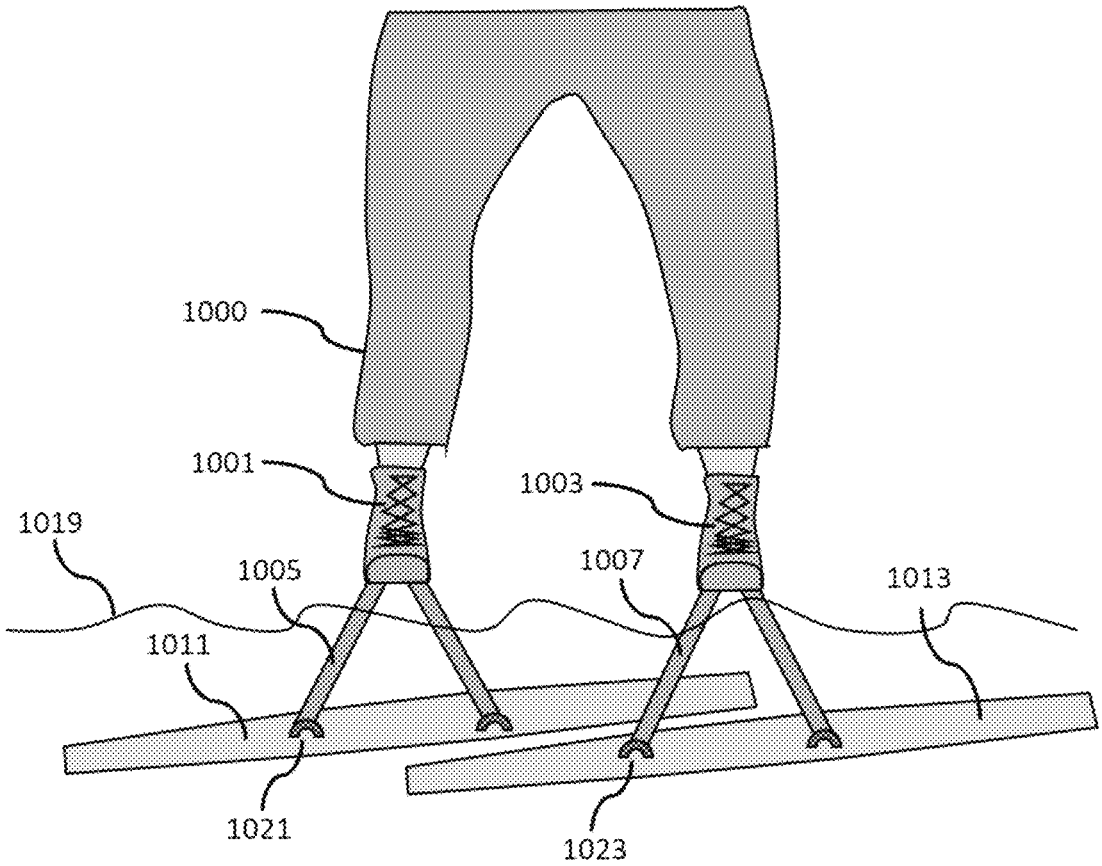
FIG. 10 illustrates schematically a human-powered hydrofoil device with pivoting blades attached to each of the person's feet.

FIG. 10 illustrates an alternative embodiment of the invention which acts as a human powered hydrofoil rather than a swim fin, with the person oriented vertically and lifted completely out of the water 1019 during operation. A right blade 1011 and a left blade 1013 are connected to a right foot attachment 1001 and a left foot attachment 1003 by a connecting right pivot 1021 and a connecting left pivot 1023, and a right post 1005 and a left post 1007. The post 1005 may be split into two halves as shown for increased strength and stability, with each half connected to the blade 1011 with its own pivot 1021. The right blade is connected to a foot of a person 1000 in an orientation that is approximately perpendicular to the legs of the person 1000. In this arrangement, the person orients their body in a substantially upright position in the water and pumps their feet up and down. The blades 1011 and 1013 generate both forward force and vertical lift as the person 1000 starts to move through the water. As the person 1000 continues to pump their legs, the forward velocity increases and the vertical force from the blades 1011 and 1013 lifts the person 1000 completely out of the water, allowing the person to move across the water as a human hydrofoil. Speed and height above water is controlled by leaning forward or back, while turning can be induced by leaning to one side or the other. The pivot mechanism 1021 and 1023 allows the blades 1011 and 1013 to present an optimum angle of attack to the water for both the downstroke and the upstroke of the legs.

The pivot mechanism 1021 may be a hinge, or a shaft with a bearing, or a flexible member such as a leaf spring, or rubber, or polymeric mount. A spring or rubber bumper may be combined with a hinge or shaft for better control. Two different spring constants, one for upward motion and one for downward motion, may be used to account for the stronger force of the downstroke. The range of motion may be limited by some stop mechanism to also help control the attack angle.

The post 1005 connecting the foot attachment to the blades can be given a hydrodynamic shape to reduce drag, while at the same time providing lateral stability, similar to the fin of a surfboard. It also may incorporate a quick disconnect from the foot attachment 1001 to allow the user to more easily enter and exit from the water. In one embodiment, this disconnect mechanism is similar to the attachment of a snow ski to the ski boot. The foot attachment 1001 may be a hard plastic shell or other stiff material, possibly similar to a ski boot, in order to provide a stiff coupling between the leg and the foil blade 1011.

Figure 11:
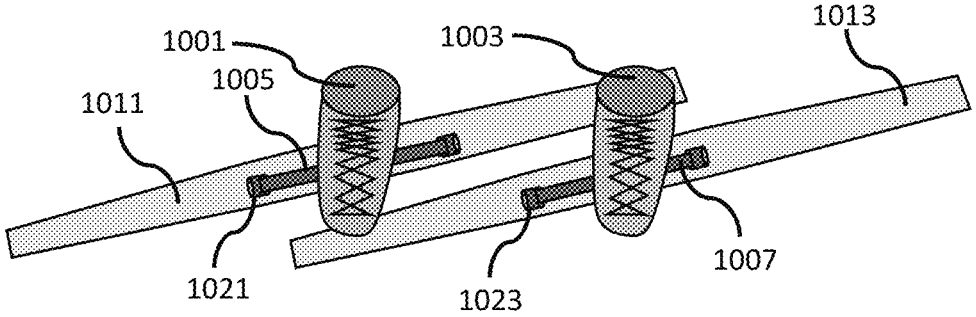
FIG. 11 illustrates schematically a top view of the hydrofoil device showing how the blades are angled so that they can pass each other without interference as the person moves their legs up and down.

FIG. 11 shows a vertical perspective of the hydrofoil. The right blade 1011 is angled relative to the right foot attachment 1001 such that the inner portion of the right blade 1011 passes behind the left blade 1013 as the person 1000 pumps their legs up and down. Likewise, the inner portion of the left blade 1013 is angled relative to the foot attachment 1003 such that the inner portion of the left blade 1013 passes in front of the right blade 1011 without contact as the person 1000 pumps their legs up and down. As would be obvious to one skilled in the art, the angle of the right blade 1011 and left blade 1013 may be reversed such that the inner portion of the right blade 1011 passes in front of the left blade 1013. The blades 1011 and 1013 may also incorporate a jog instead of an angle, similar to the jog in blade 811 from FIG. 8 to enable them to pass by each other without contact.

Figure 12A:
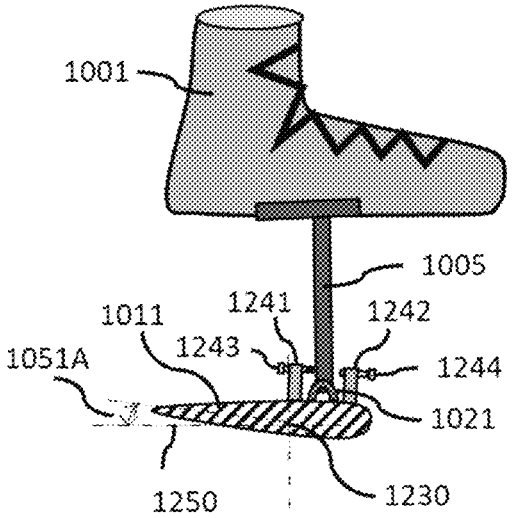
FIG. 12A and FIG. 12B illustrates schematically a side view of the hydrofoil device showing the hydrodynamic shape of the blade and how it pivots as the person moves their legs up and down.
Figure 12B:
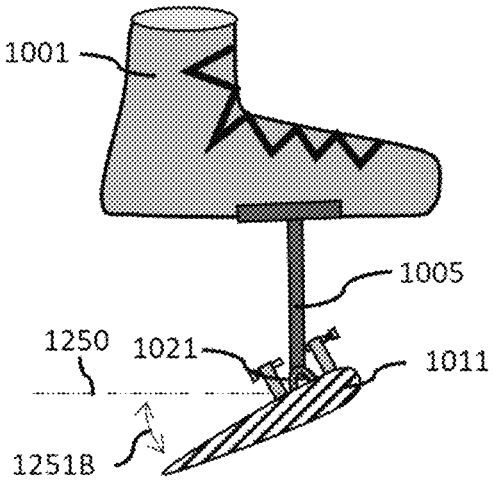

FIG. 12A shows a side view of the right hydrofoil with the right blade 1011 angled relative to the horizontal direction 1250 such that it presents an optimum angle of attack 1251A through the water as the right leg of the person 1000 is pumped in a downward direction. As seen from the cross-section of the blade 1011, the blade has a hydrodynamic shape to improve lift and reduce drag as it moves through the water. The shape may have a larger curvature on the top surface, similar to an airplane wing, to improve the upward lift. FIG. 12B shows a side view of the right hydrofoil with the right blade 1011 angled relative to the horizontal direction 1250 such that it presents an optimum angle of attack 1251B through the water as the right leg of the person 1000 is pumped in an upward direction. The angle 1251A on the downward stroke is generally smaller than the angle 1251B on the upward stroke, so that the average angle is in an upward direction. In some cases, the angle 1251A may be zero relative to the horizontal or even angled slightly upward, although less than angle 1251B. The center of pressure 1230 of the right blade 1011 is located behind the pivot 1021 so that the force of water pressure automatically pivots the blade to the correct angle. A downward stop 1241 and an upward stop 1242 limit the pivot motion of the right blade 1011 such that the blade maintains an optimal angle of attack to the water. The stops may include an adjustment mechanism such as a screw 1243 and 1244 so the angle of attack can be optimized for different people or conditions. In some embodiments, the adjustment may be controlled when the device is in operation by means of a cable or remote control. Other stop mechanisms known to those skilled in the art may be used. A spring or elastic mechanism may also be used to help control the angle of attack, either by itself or in combination with stops 1241 and 1242.

Figure 13:
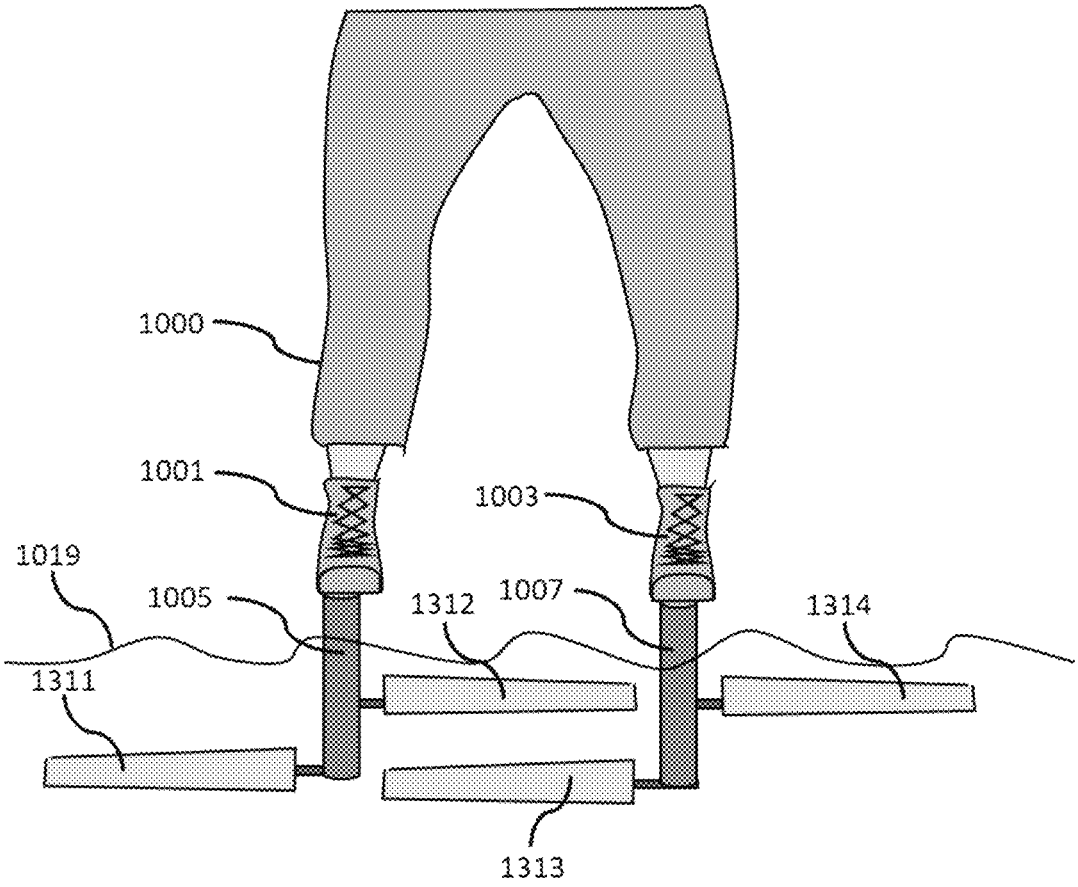
FIG. 13 illustrates schematically an alternative embodiment of the hydrofoil device where the inner portion of one blade is positioned closer to the body than the inner portion of the other blade.

FIG. 13 illustrates an alternate arrangement of blades where an inner portion 1312 of the right blade is positioned closer to the body of the person than an inner portion 1313 of the left blade. This allows the person to move their feet alternately up and down without the right blades 1311 and 1312 interfering with the left blades 1313 and 1314. As would be obvious to one skilled in the art, the relative positioning of the left and right blades may be reversed.

Figure 14:
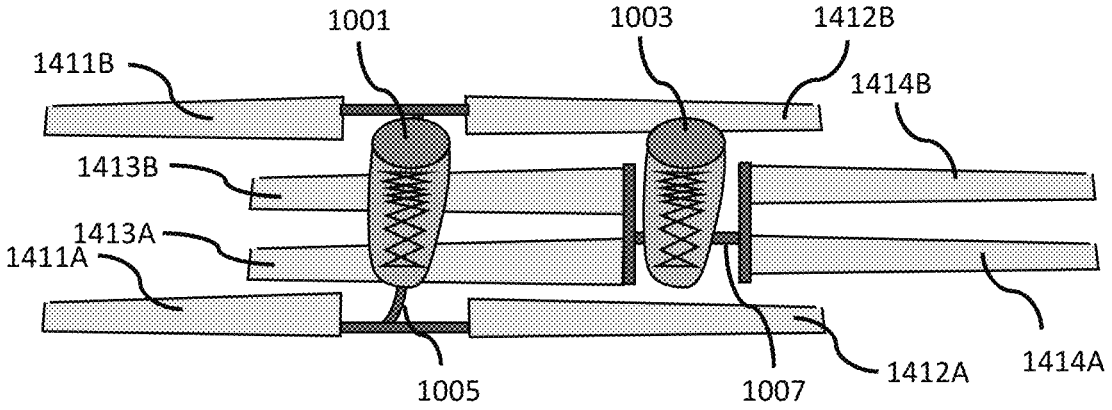
FIG. 14 illustrates schematically an alternative embodiment of the hydrofoil device where multiple blades are attached to each foot.

FIG. 14 shows a top-down view of an alternate arrangement of blades where the right foot is attached to four blades—a front outer blade 1411A, a rear outer blade 1411B, a front inner blade 1412A, and a rear inner blade 1412B. Similarly, the left foot is attached to four blades—a front outer blade 1414A, a rear outer blade 1414B, a front inner blade 1413A, and a rear inner blade 1413B. The left blades are spaced closely while the right blades are spaced farther apart, allowing the blades to pass each other without interference as the person moves their legs up and down. This arrangement has the advantage of a wider overall spacing of blades which helps to increase the balancing stability of the person. It also allows an increase in the overall blade area for improved lift at lower speeds, while keeping a high aspect ratio of the blades which improves hydrodynamic efficiency. As would be obvious to one skilled in the art, the relative spacing of the left and right blades may be reversed.

What is claimed is:

1. A pair of devices for propelling a body of a person through water, consisting of:

a. a left foot attachment and a right foot attachment;

b. a set of four blades, consisting of a left outer blade attached to an outside of the left foot attachment, a left inner blade attached to an inside of the left foot attachment, a right outer blade attached to an outside of the right foot attachment, and a right inner blade attached to an inside of the right foot attachment;

c. a left pivot mechanism and a right pivot mechanism whereby the left inner blade and the left outer blade can change an angle with respect to the left foot attachment, and the right inner blade and the right outer blade can change an angle with respect to the right foot attachment, as the person moves the left foot attachment and the right foot attachment either upwards or downward;

wherein the right inner blade is positioned such that the right inner blade can pass the left inner blade without contact as the person moves the right foot attachment and the left foot attachment past each other up and down in a swimming motion.

2. The pair of devices of claim 1, wherein the left inner blade is either closer to or farther from the body in a longitudinal direction than the right inner blade.

3. The pair of devices of claim 2, wherein a left combined center of pressure of the left inner blade and the left outer blade is substantially centered on said left foot attachment in a lateral direction; a right combined center of pressure of the right inner blade and the right outer blade is substantially centered on said right foot attachment in the lateral direction; and the left combined center of pressure and the right combined center of pressure are both substantially equally far from the body of the person in the longitudinal direction.

4. The pair of devices of claim 2, further including a spring mechanism used to control the angle with respect to the left foot attachment and the right foot attachment of the set of four blades.

5. The pair of devices of claim 2, further including a left disconnect mechanism and a right disconnect mechanism to allow the set of four blades to be detached from the left foot attachment and the right foot attachment.

6. The pair of devices of claim 2, further including a left fairing connected to the left foot attachment and a right fairing connected to the right foot attachment.

7. The pair of devices of claim 2, wherein the left pivot mechanism and the right pivot mechanism are each comprised of a spring flexure.

8. The pair of devices of claim 2, wherein the left pivot mechanism and the right pivot mechanism are each comprised of a rotary bearing.

9. The pair of devices of claim 2, wherein the left inner blade is rigidly connected to the left outer blade such that both the left inner blade and the left outer blade pivot together, and the right inner blade is rigidly connected to the right outer blade such that both the right inner blade and the right outer blade pivot together.

10. The pair of devices of claim 2, wherein the left inner blade, the left outer blade, the right inner blade, and the right outer blade can each pivot independently.

11. A pair of devices for propelling a body of a person through water, consisting of:

a. a left foot attachment and a right foot attachment;

b. a left blade with an inner portion and an outer portion, attached to the left foot attachment, and a right blade with an inner portion and an outer portion, attached to the right foot attachment, where the left blade and the right blade are longer in a lateral direction perpendicular to the body than in a longitudinal direction parallel to the body;

c. a center of pressure of the left blade which is substantially centered on said left foot attachment in the lateral direction; a center of pressure of the right blade which is substantially centered on said right foot attachment in the lateral direction; wherein the center of pressure of the left blade and the center of pressure of the right blade are both substantially equally far from the body of the person in the longitudinal direction;

d. a left pivot mechanism and a right pivot mechanism allowing the left blade to change an angle with respect to the left foot attachment and the right blade to change an angle with respect to the right foot attachment as the person moves the left foot attachment and the right foot attachment either upwards or downwards;

wherein the inner portion of the right blade is positioned such that the inner portion of the right blade can pass the inner portion of the left blade without contact as the person moves the right foot attachment and the left foot attachment past each other up and down in a swimming motion.

12. The pair of devices of claim 11, wherein said right blade is shaped or angled such that the inner portion of said right blade is either closer to or farther from the body in the longitudinal direction than the inner portion of said left blade.

13. The pair of devices of claim 12, further including a spring mechanism connected to the left foot attachment used to control the angle with respect to the left foot attachment of the left blade, and a spring mechanism connected to the right foot attachment used to control the angle with respect to the right foot attachment of the right blade.

14. The pair of devices of claim 12, further including a left disconnect mechanism allowing the left blade to be detached from the left foot attachment and a right disconnect mechanism allowing the right blade to be detached from the right foot attachment.

15. The pair of devices of claim 12, further including a left fairing connected to the left foot attachment and a right fairing connected to the right foot attachment.

16. The pair of devices of claim 12, wherein the left pivot mechanism and the right pivot mechanism are each comprised of a spring flexure.

17. The pair of devices of claim 12, wherein the left pivot mechanism and the right pivot mechanism are each comprised of a sleeve bearing or other similar rotary bearing.

18. A pair of devices for propelling a body of a person above the surface of the water, powered by said person, consisting of:

a. a left blade connected to a left foot attachment and a right blade connected to a right foot attachment;

b. a left connecting post disposed between the left blade and the left foot attachment and a right connecting post disposed between the right blade and the right foot attachment;

c. A left pivot mechanism connected to the left blade and a right pivot mechanism connected to the right blade allowing the left blade to change an angle with respect to the left foot attachment, and the right blade to change an angle with respect to the right foot attachment, as the person moves the left foot attachment and the right foot attachment up and down.

19. The pair of devices of claim 18 wherein an inner portion of said left blade is mounted either in front of or behind an inner portion of said right blade, whereby said person can move the left foot attachment up and down and the right foot attachment down and up without contact between the left blade and the right blade.

20. The pair of devices of claim 18 further including an adjustment mechanism that allows said person to adjust the angle with respect to the left foot attachment of the left blade, and the angle with respect to the right foot attachment of the right blade.

* * * * *